US006523234B1

(12) United States Patent
Bathelier

(10) Patent No.: US 6,523,234 B1
(45) Date of Patent: Feb. 25, 2003

(54) DEVICE AND METHOD FOR MAKING TEXTILE PRODUCTS FROM FIBERS AND/OR FILAMENTS

(75) Inventor: Xavier Bathelier, Saint-Pierrement (FR)

(73) Assignee: SAI Automotive Sommer Industrie (FR)

( * ) Notice: Subject to any disclaimer, the term of this patent is extended or adjusted under 35 U.S.C. 154(b) by 0 days.

(21) Appl. No.: 09/958,382

(22) PCT Filed: Mar. 27, 2000

(86) PCT No.: PCT/EP00/02688

§ 371 (c)(1),
(2), (4) Date: Feb. 28, 2002

(87) PCT Pub. No.: WO00/60155

PCT Pub. Date: Oct. 12, 2000

Related U.S. Application Data

(60) Provisional application No. 60/128,016, filed on Apr. 6, 1999.

(51) Int. Cl.[7] ..... D04H 1/74
(52) U.S. Cl. ..... 28/107
(58) Field of Search ..... 28/107, 108, 109, 28/110, 113, 114

(56) References Cited

U.S. PATENT DOCUMENTS

| | | | |
|---|---|---|---|
| 3,540,098 A | 11/1970 | Ploch et al. | |
| 5,239,734 A | 8/1993 | Bathelier et al. | |
| 5,867,880 A | 2/1999 | Bathelier et al. | |
| 6,012,205 A | 1/2000 | Bathelier et al. | |

FOREIGN PATENT DOCUMENTS

| | | |
|---|---|---|
| DE | 4239469 A1 | 5/1994 |
| EP | 0479880 | 4/1992 |
| EP | 0516964 A1 | 4/1992 |
| EP | 0859077 A1 | 8/1998 |
| WO | WO 91/00382 | 1/1991 |
| WO | WO 96/10667 | 4/1996 |
| WO | WO 97/05315 | 2/1997 |
| WO | WO 98/36119 | 8/1998 |

OTHER PUBLICATIONS

Search Report for Priority Application PCT/EP 00/02688 dated Apr. 6, 1999.

English translation of Search Report for Priority Application PCT/EP 00/02688 dated Apr. 6, 1999.

*Primary Examiner*—Danny Worrell
(74) *Attorney, Agent, or Firm*—Knobbe, Martens, Olson & Bear, LLP

(57) ABSTRACT

A device for making textile products from fibers and/or filaments moving in the form of a web is essentially formed by the cross-over movement of a set of identical spaced apart looper discs located on a common transverse axis with a set of identical looper fingers. The looper discs have spaced apart teeth along their perimeter.

17 Claims, 8 Drawing Sheets

DEVICE AND METHOD FOR MAKING TEXTILE PRODUCTS FROM FIBERS AND/OR FILAMENTS

CROSS-REFERENCE TO RELATED APPLICATIONS

This application is a National Phase application of PCT application No. PCT/EP00/02688, filed Mar. 27, 2000, and claims priority to U.S. Provisional Application Ser. No. 60/128,016, filed Apr. 6, 1909, the disclosures of which are incorporated herein by reference in their entireties.

FIELD OF THE INVENTION

The present invention relates to an improved device for manufacturing textile products directly from fibers and/or filaments. The invention also relates to a process for using the device.

DESCRIPTION OF THE RELATED ART

The present invention relates substantially to the production of products obtained by the technique known as the "verticalization technique" and which has been refined by the Applicant.

This technique is described in European patent EP A 0,479,880 and allows textile products and more specifically floor and/or wall coverings of carpet type to be produced directly from fibers and, or filaments travelling in the form of a web.

The Applicant has also proposed in document EP A 0,783,608 to adapt this technique to the production of knitted products.

The verticalization technique described consists in subjecting the fibers and/or filaments to a "transverse looping" accompanied by a "drawing" and in obtaining an accumulation of the fibers and/or filaments in the form of a "pseudo-yarn" in which the fibers and/or filaments are parallelized.

In these documents, it is described that the transverse looping accompanied by drawing is carried out for each individual fiber or filament by means of rotary looping elements or discs, which are spaced apart and arranged on a shaft transverse to the direction of advance of the web and between which are arranged looping fingers. In this way, each fiber or filament is, in principle, involved in at least one looping so as to form a twistless pseudo-yarn obtained by the accumulation of the exactly parallelized elementary fibers and/or filaments. This twistless pseudo-yarn consisting of the parallelized fibers and/or filaments may be either manipulated by needles of tufting needle type and may be conveyed towards a support in order to make carpets as described in details in publication EP A 0,479,880, or may be entrained by knitting needles in order to produce knitted products as described in details in publication EP A 0,783,608, or alternatively may be used to produce products of lapsed-bonded type as described in details in publication EP A 0,960,227.

The conditions which had been established at the time of filing of patent application EP A 0,479,880 appeared to be twofold: firstly, most of the components constituting the web, i.e. the individual fibers and/or filaments, needed to have an angle of orientation with respect to the feed direction of the web which was between 5 and 45 degrees and more specifically between 15 and 25 degrees; secondly, the web of fibers and/or filaments at the outset needed to have a low weight per unit area, preferably between 10 and 50 g/m2.

The condition relating to the orientation which the fibers and/or filaments need to have relative to the feed direction is a minimum condition of profitability as regards the lower angle. The reason for this is that, below a particular angle, the fibers and/or filaments run the risk of no longer being correctly parallelized during the production of the pseudo-yarn, thus impairing the efficiency of the product. By contrast, as regards the maximum angle, this is an angle which constitutes a compromise between theory and practice, that is to say that when fibers and/or filaments have an angle greater than this limit of 45 degrees, it is considered that, in theory, the process could still be carried out, but it is observed that the fibers and/or filaments would generate forces which increase exponentially with the angle of orientation of the fibers for the device formed by the interpenetration of the looping discs with the looping fingers, which would thus necessitate an oversizing of the parts, and in particular of the shaft supporting the looping discs.

At the time of production of the prototype using the process described in the patent, the Applicant had therefore proposed to satisfy the first of the conditions by ensuring an orientation of the fibers relative to the feed direction by means of a "transverse pre-drawing" which was substantially carried out by the interpenetration of two sets of discs arranged upstream of the looping discs/looping fingers device.

Nevertheless, at the time of production of a machine with a width of 4 m, for example, such a technical solution proved difficult to implement for the following reasons: the difficulty in controlling the lateral expansion of the web at high speed (formation of folds, etc.) under satisfactory productivity conditions; the difficulty in suitably orienting certain types of fibers, and in particular fibers longer than 250 mm or continuous filaments.

In publication WO 97/05315, the Applicant had proposed a process known as the DUO process in which the processing of the fibers and/or filaments is split by carrying out a pre-looping step which is referred to as the crimping step. The looping step is carried out conventionally using a device consisting of the interpenetration of a first set of looping discs with a first set of looping fingers, while the prior crimping step is also carried out using a device consisting of the interpenetration of a second set of discs known as crimping discs with a second set of fingers known as crimping fingers. The process described in publication WO 97/05315 was characterized in that the crimping device arranged upstream of the looping device relative to the feed direction had a gauge which was a multiple of the gauge of the looping device. This configuration made it possible in a particularly advantageous manner to reduce the forces applied on the fibers during their processing and to produce a product without breaking fibers while at the same time limiting the dimensions of the machine parts.

Although this solution was tested successfully at the industrial scale, it has a certain number of drawbacks. In particular, implementing such a process requires the presence of machines arranged upstream of the present device and consisting of a of long-fiber carding machine 2.5 m wide and its feeder, a conventional lap machine lapping in a width of 4 m and also a longitudinal stretcher. This type of line intended to feed a 4 m device makes it possible to produce/process up to 800 kilos per hour.

The device consisting of the crimping assembly and the looping assembly producing the DUO device made it possible to obtain a stroke speed of 1000 strokes per minute according to the limits of the current technology, thus making it possible to produce/process between 200 and 250 kilos per hour, whereas a conventional nonwoven line remains three to four times more productive than a device of DUO type as described above.

This results in an inadequacy between upstream production (card/lapper/drawer) and downstream device (DUO device) which in practice is reflected by excessive investments costs and mediocre profitability.

In addition, the fact that a large number of upstream devices or machines is proposed proves to be difficult to manage. A critical point consists of the stoppages caused by machine faults, in particular of the downstream devices (DUO device). Specifically, the inertia of the carding machine makes it necessary to recycle the web and then reintroduce it into the DUO machine.

Another drawback arises as regards the covering quality, that is to say the superposition of the webs at the folds. Poor covering will inevitably be reflected by the appearance of a darker or lighter transverse line in the finished products.

Finally, the relative complexity of the DUO devices, which are difficult to adjust, may cause fouling zones for certain fibers.

In particular, the presence of detaching elements or strippers in the pre-looping device requires a precise adjustment of their arrangement, which will vary according to the nature of the fiber used. Moreover, after disassembly following jamming, for example, it is relatively difficult to reposition these detaching or stripping elements.

SUMMARY OF THE INVENTION

The present invention aims to solve these various problems while at the same time allowing the use of inexpensive and better suited upstream equipment, and in particular the use of carding machines of cotton carding machine type which are carding machines for short fibers optionally with elimination of the lap machine and its replacement with a transverse drawer.

The present invention aims also to dispense with the presence of detaching elements, and thus to simplify the production of the verticalization devices.

Finally, the present invention aims, by reducing the forces, to reduce the sizes of the various members and in particular of the rotary members in the verticalization devices.

The present invention relates to a device for manufacturing textile products from fibers and/or filaments travelling in the form of a web, consisting substantially of the interpenetration of a set of identical spaced-apart looping discs located on a common transverse shaft with a set of identical looping fingers, characterized in that the looping discs have on their perimeter teeth that are relatively spaced apart.

The expression "relatively spaced apart" means that the distance separating two successive teeth on the perimeter of a looping disc is at least three times the width of an individual tooth.

Preferably, the number of teeth on the perimeter of a looping disc is between 8 and 16.

Preferably, the distance between two successive teeth on the perimeter of a looping disc is between 20 and 60 mm.

Preferably, the height of the teeth is between 1 and 5 mm.

Advantageously, the slope of the teeth facing the arrival of the web is between 20 and 40 degrees.

Advantageously, the distance between two successive teeth on the perimeter of a looping disc does not exceed 1.5 times the average length of the fibers and/or filaments of the web.

A transfer member, preferably a knitting element or a needle, is arranged in the extension of each looping finger. These transfer members, and preferably the needles, carry out a rectilinear sinusoidal movement obtained using a rod/cam system.

In addition, the rotational movement of the looping discs located on a common transverse shaft is uniform.

Advantageously, the movement of the transfer elements or needles and the rotational movement of the looping discs is obtained with the aid of a single main control arm supporting cams and having a gear reduction which is defined by the number of teeth.

The present invention also relates to a process for manufacturing textile products from fibers and/or filaments travelling in the form of a web, in which: the fibers and/or filaments are subjected to a transverse looping accompanied by a drawing using an assembly consisting of the interpenetration of a set of identical spaced-apart looping discs located on a common transverse shaft with a set of identical looping fingers, the looping discs having on their perimeter teeth that are relatively spaced apart; the fibers and/or filaments are accumulated in the form of at least one crimped pseudo-yarn of a certain length in which the fibers and/or filaments are parallelized, this accumulation of said fibers and/or filaments being carried out against the slope of a tooth facing the arrival of the web; and, the crimped pseudo-yarn is transferred towards knitting elements or the set of needles simultaneously over the entire length of the pseudo-yarn. Preferably, the web of fibers and/or filaments has on entry a weight of between 10 and 30 g/m2.

Advantageously, the average orientation of the fibers and/or filaments in the web when entering the device is between 10 and 25 degrees relative to the feed direction of the web.

Advantageously, the entry web consists of fibers and/or filaments between 20 and 70 mm in length.

Preferably, a transverse drawing is carried out on the web prior to the first step consisting in subjecting the fibers and/or filaments to a transverse looping accompanied by a drawing.

DETAILED DESCRIPTION OF THE PREFERRED EMBODIMENT

Figure 1:
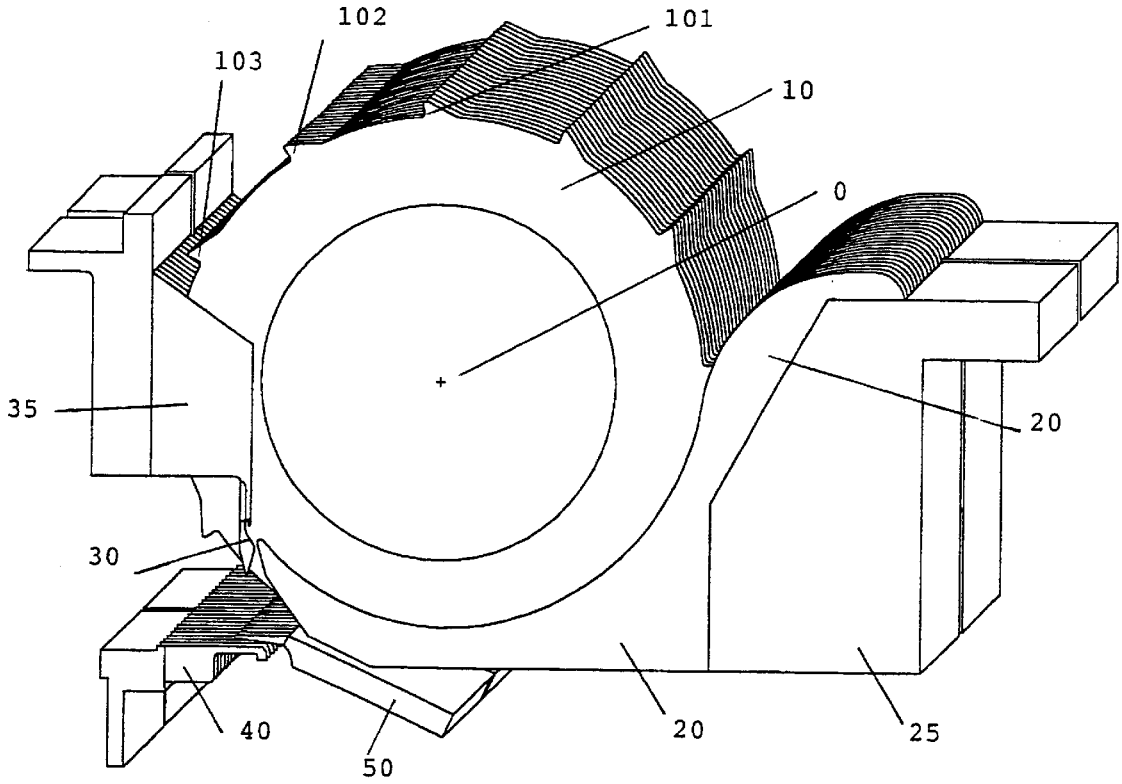
FIG. 1 represents a perspective view of the device for carrying out the process according to the present invention.
Figure 2:
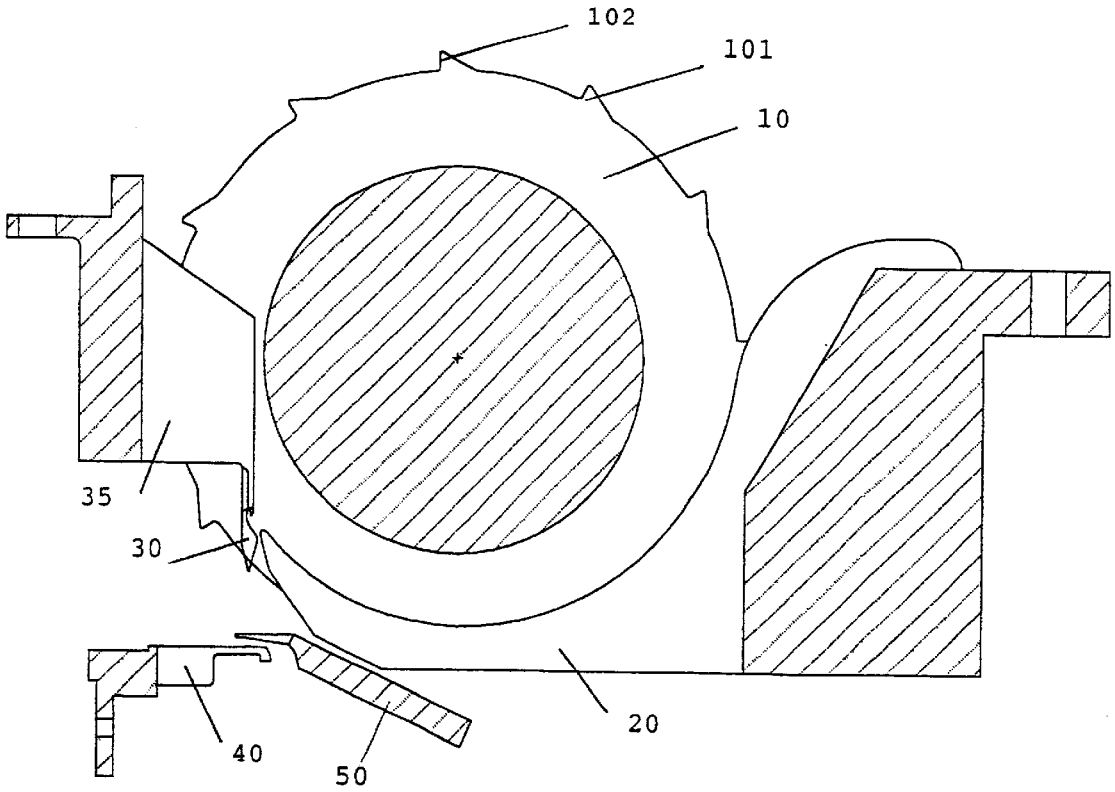
FIG. 2 represents a cross section view of the device represented in FIG. 1.

The devices described in FIGS. 1 and 2 are devices according to the present invention which use the "verticalization" technique which was described in great detail in publications EP A 0,479,880, WO 96/10667 and WO 97/05315. These documents are incorporated by way of reference into the present patent application.

In practice, in order to obtain a pseudo-yarn, a transverse looping is carried out, accompanied by a drawing for each individual fiber and/or filament by means of the interpenetration of metal components so as to give each fiber and/or filament a crimped shape. The looped elementary fibers and/or filaments are then accumulated by compression in the feed direction in order to constitute a transverse row of loops. This accumulation makes it possible to obtain very good parallelization of the fibers. At this stage, a pseudo-yarn in crimped form having the desired thickness (or yarn count) has thus been made, except for the twist.

In addition, the entire preparation of the web in order to obtain a pseudo-yarn, that is to say the opening, carding, lapping and pre-orienting of the fibers, may be carried out according to the methods described in document EP A 0,479,880. Optionally, the improvements described in the parallel patent application based on the priority EP 99870152.8, which describes a process for orienting and drawing the fibers and/or filaments of a web, may be applied thereto.

By carrying out the process described in the above-mentioned parallel patent application, it is observed that there is also a relationship between the drawing value and the minimum orientation angle. For a web consisting of short 60 mm fibers drawn transversely by a factor of 2, these fibers will have an average angle of about 20 degrees with a standard deviation of 5 degrees. Using a web of fibers and/or filaments as proposed in this patent application, it is observed that only very small forces are generated during the treatment with the device according to the present invention, due to the true orientation of the fibers constituting said web.

FIGS. 1 and 2 represent the device for carrying out the process according to the present invention. The device consists substantially of the interpenetration of a set of identical "looping" discs 10, spaced apart and located on a common transverse shaft 0, with a set of "looping" fingers 20, that are also identical. The looping discs 10 are driven at a rotation speed which is preferably constant and uniform and defined so that the peripheral speed of the looping discs is equal to the entry speed of the web consisting of fibers and/or filaments.

As already mentioned, a looping finger is arranged between two successive looping discs. The interpenetration of the various looping discs with the looping fingers causes a looping accompanied by an individual transverse drawing of the fiber and/or filament as described in details in the prior publications EP A 0,479,880, WO 96/10667 and WO 97/05315.

According to the present invention, these looping discs 10 are fitted with teeth 101, 102, 103 that are relatively spaced apart. The expression "relatively spaced apart" means that the distance separating two successive teeth 101 and 102, for example, on the perimeter of the disc is at least three times the width of an individual tooth.

The distance between two consecutive teeth is defined by the accumulation value of the fibers and/or filaments of the web to create the pseudo-yarn of desired yarn count.

Preferably, the number of teeth present on the perimeter of a looping disc is between 8 and 16. The number of teeth depends on the diameter of the discs and also on the ratio between the weight of the desired product and the weight of the entering web.

The teeth present on these discs might be substantially sized in the same way as the continuous teeth present on the discs of the prior art with regards to the web-driving function. However, the other functions require a quite specific shape. The function of driving the yarn to the eye of the needle requires a sufficient height, preferably at least equal to 3 mm. The function of releasing the yarn from the tooth during the descent of the needles will necessitate a precise, slightly curved profile of the active part of the tooth.

Preferably, the slope of the tooth which is facing the advancing web is between 20 and 40 degrees, which thus allows a good penetration into the web while at the same time allowing an easy release of the loop made constituting the pseudo-yarn towards the collecting and transfer members.

Indeed, in the extension of each looping finger 20 is provided a transfer member which may be a knitting element or, as represented in FIGS. 1 and 2, a needle 30. The set of transfer members, and more specifically the needles 30, makes it possible to collect and transfer the pseudo-yarn obtained by accumulation of the fibers and/or filaments.

These needles 30 are securely fastened to a projection 35 and simultaneously perform a to-and-fro movement which may in particular be a sinusoidal rectilinear movement generated by a rod/cam system.

The purpose of these needles 30 is to transfer the pseudo-yarn by perforating a support which is placed on a series of anvils 40 on which it moves. This support, not shown, is intended to produce the floor covering.

These anvils 40 serve as elements for reacting to the penetration of the needles 30 into the support. In addition, hooks 50 are conventionally provided, which, when used together with knives, not shown, allow the production of a floor covering in the form of cut tuft or velvet.

Figure 3:
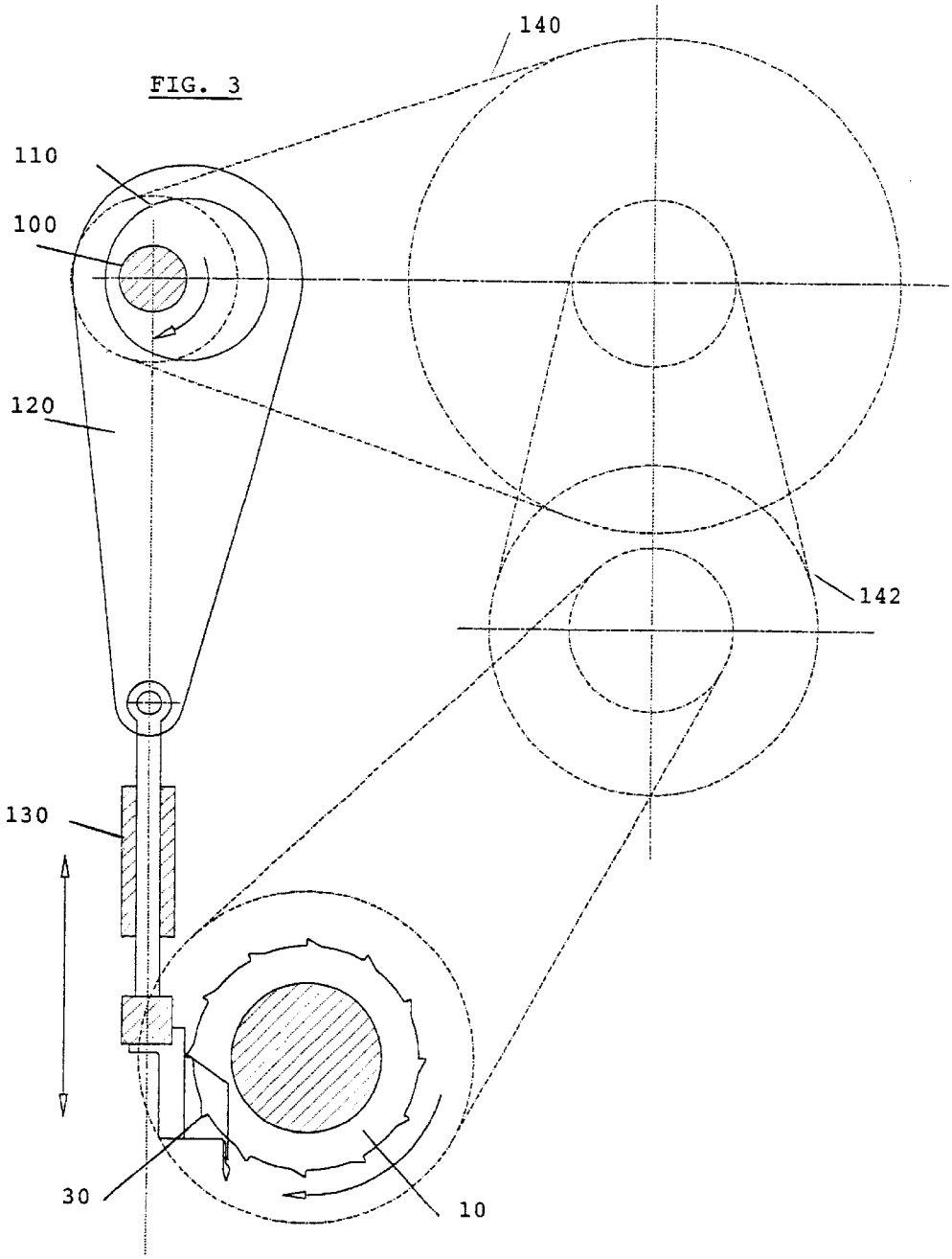
FIG. 3 represents a cross section view of the device for driving the main members of the device according to the invention, namely the needles and the looping discs.

The movement of the needles 30 and the rotational movement of the looping discs 10 is obtained with the aid of a single main control shaft 100 supporting cams 110 connected to a conventional rod 120/slide 130 assembly provided with a transmission 140, 142 as far as the looping shaft 0 which has a gear reduction equal to the number of teeth 101, 102 present at the periphery of a disc 10, as represented in details in FIG. 3.

As described in further details in FIG. 4, it is observed that a fiber whose head is pinched by a tooth will be able to be entrained as far as the needles without ever being tensioned to the point of becoming blocked along a finger. This fiber will then be able to entrain the other fibers of the web without there necessarily being any actual contact with the teeth.

The low forces generated during this treatment (looping step) make it impossible to obtain a bulking effect in which the positive entrainment of a few fibers allows the entrainment of the entire web. It is also observed that this bulking effect takes place as long as the distance between two consecutive teeth on the same disc only slightly exceeds the average length of the fibers present in the web.

Other advantages may be observed by using the process according to the present invention.

In particular, the visibility of the working zone will be increased. The reason for this is that the present invention dispenses with the presence of detaching elements, which masked the view of the needles and prevented the operator from anticipating problems such as jamming.

In particular, the fact that it is not necessary to use additional members such as detaching elements allows to produce a device which is easier to produce and maintain. The reason for this is that these additional members such as detaching elements were particularly difficult to arrange correctly within the verticalization device.

In addition, the accumulation defects of the fibers and/or filaments in the eye of the needles are eliminated or reduced by using the process according to the present invention. Specifically, this accumulation, which was not really positive according to the prior art, could be the cause of defects which were reflected directly on the finished product by holes or gaps.

A large reduction in the general level of tolerances is also observed by using the process and the device according to the present invention. Specifically, a slight distortion of a disc, for example, which reduces the play between needle and disc, will have only very little or at least a reduced influence by using the process as described above. The reason for this is that the spaced-apart teeth present on the second set of discs will be able to push the loops behind the needles.

In a particularly advantageous manner, it is also observed that the looping forces are reduced when compared with the solutions described according to the prior art by using the process and the device according to the present invention. The reason for this is that the discs with continuous teeth are found to be particularly difficult to polish at the bottom of the tooth. It should be noted that polishing is essential in order for the fibers to be able to loop and move transversely relative to the discs. In reality, the consequence of this is an increase of the fiber/metal frictions. By using the spaced-apart teeth as described above for the second set of discs, it is observed that the fibers move in the smooth parts between two consecutive teeth, these parts being readily accessible at the time of polishing. The reduction in the forces resulting therefrom goes hand in hand with the reduction in the friction and thus makes it possible to achieve higher operating speeds.

Finally, it should be noted that the needles intended for producing tufted products or knitted products are greatly simplified. Specifically, the reduction in the forces and thus in the torque on the disc shaft allows a smaller disc diameter and thus a reduction in the projection of the needles. Similarly, the elimination of the detaching elements also makes it possible to reduce the height of the needle. The needles consequently have a more compact design and are more rigid and, as a result, less expensive to produce.

FIGS. 4*a* to 4*e* more particularly describe the various stages in the formation of a yarn according to the process of the present invention and its transfer to the needles. For better understanding of the figures, it is understood that the needles are driven by a sinusoidal rectilinear movement and that their position is read as a function of the angle expressed in degrees of the control shaft, the top dead point corresponding to zero degrees. During a complete cycle of the needle, i.e. 360 degrees, the disc which is driven in a uniform circular movement turns by 360/n degrees where n is the number of teeth.

Figure 4A:
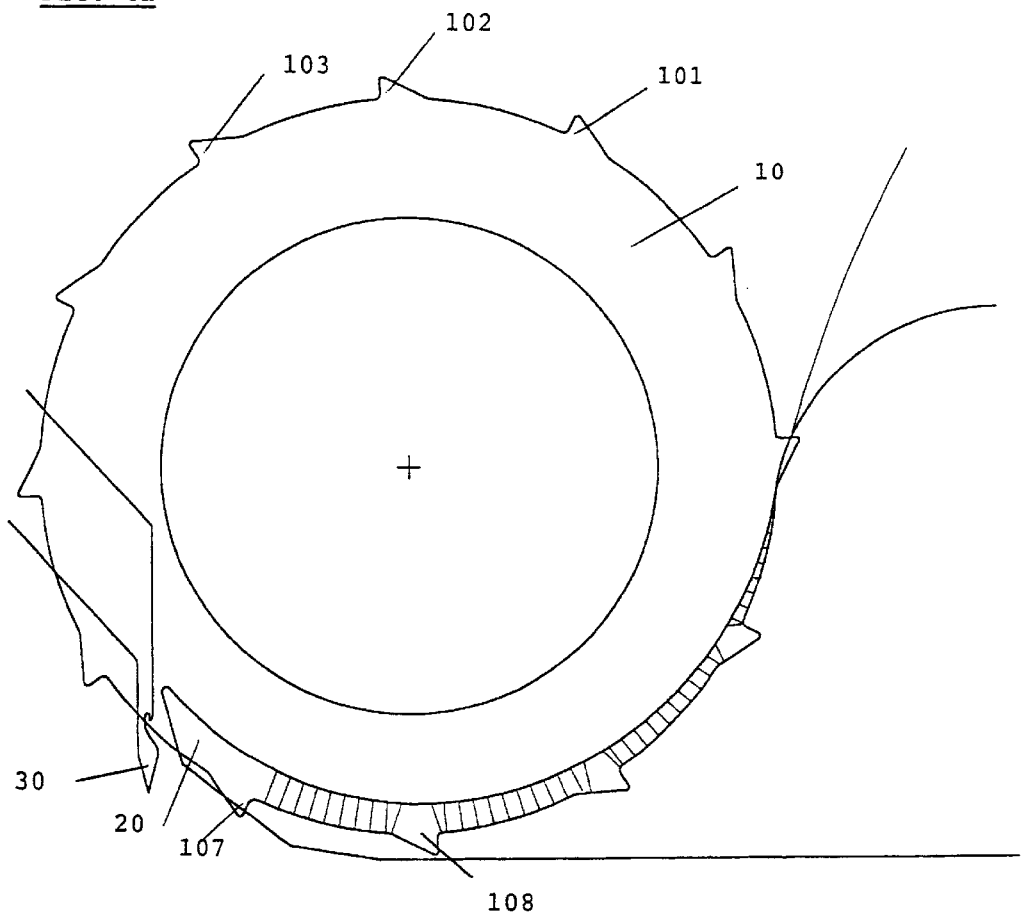
FIGS. 4*a* to 4*e* represent the various stages in the formation of a yarn according to the process of the present invention and its transfer to the needles.

FIG. 4*a* (position of the needle at 60 degrees)

The web has been introduced and has started its progress towards the needles. The bulking effect described previously allows a uniform distribution of the fibers during the looping step except for at the very position of the teeth where the fibers are pushed back slightly due to the "tip" effect of the top of the tooth which penetrates into the web at the time of its engagement. If this tip effect did not take place, certain fibers would loop by a value greater than the desired value (corresponding to the depth of the tooth), which would harm the yield. The depth of the tooth and also its general shape must take account of this.

Figure 4B:
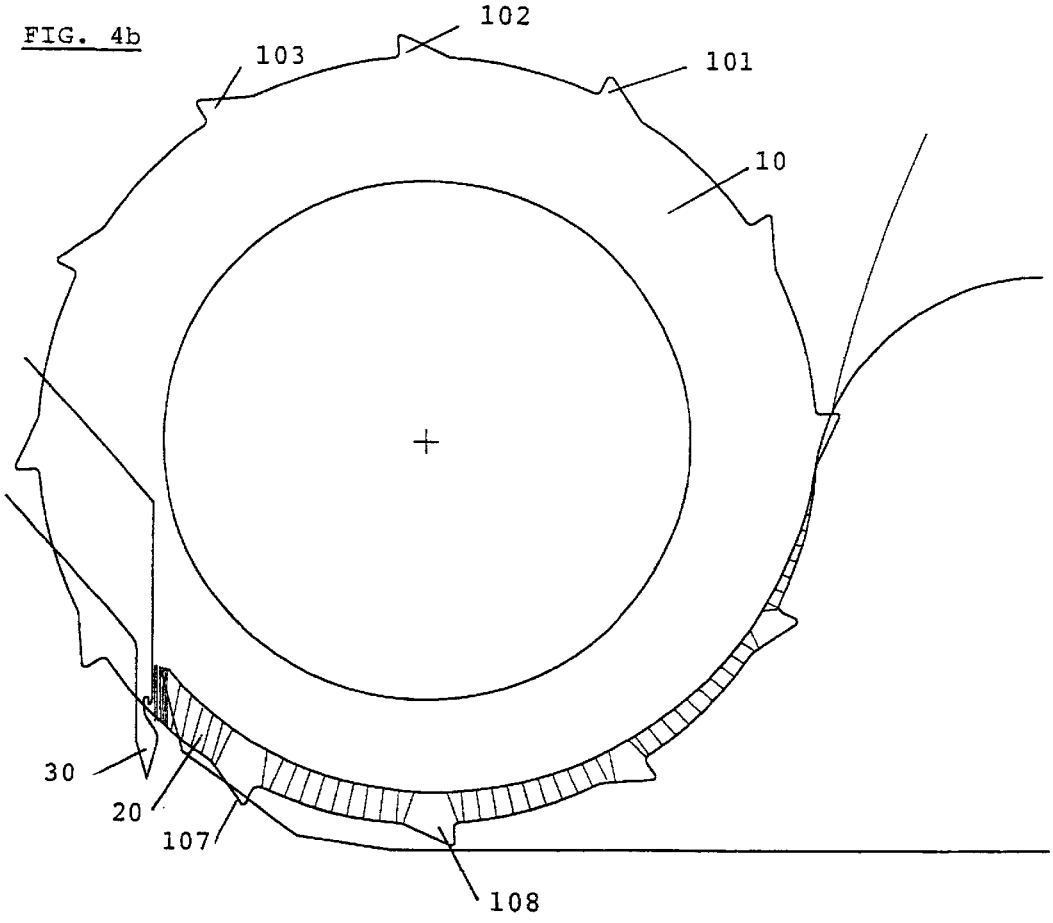

FIG. 4*b* (position of the needle at 60 degrees in the following cycle)

The discs continue to entrain the crimped web (during this time, the needle has completed a full cycle) which will thus meet the shank of the needle. This obstacle is sufficient to block the progress of the fibers, which accumulate one behind the other in the form of elementary loops until the pseudo-yarn of the desired yarn count is made.

Figure 4C:
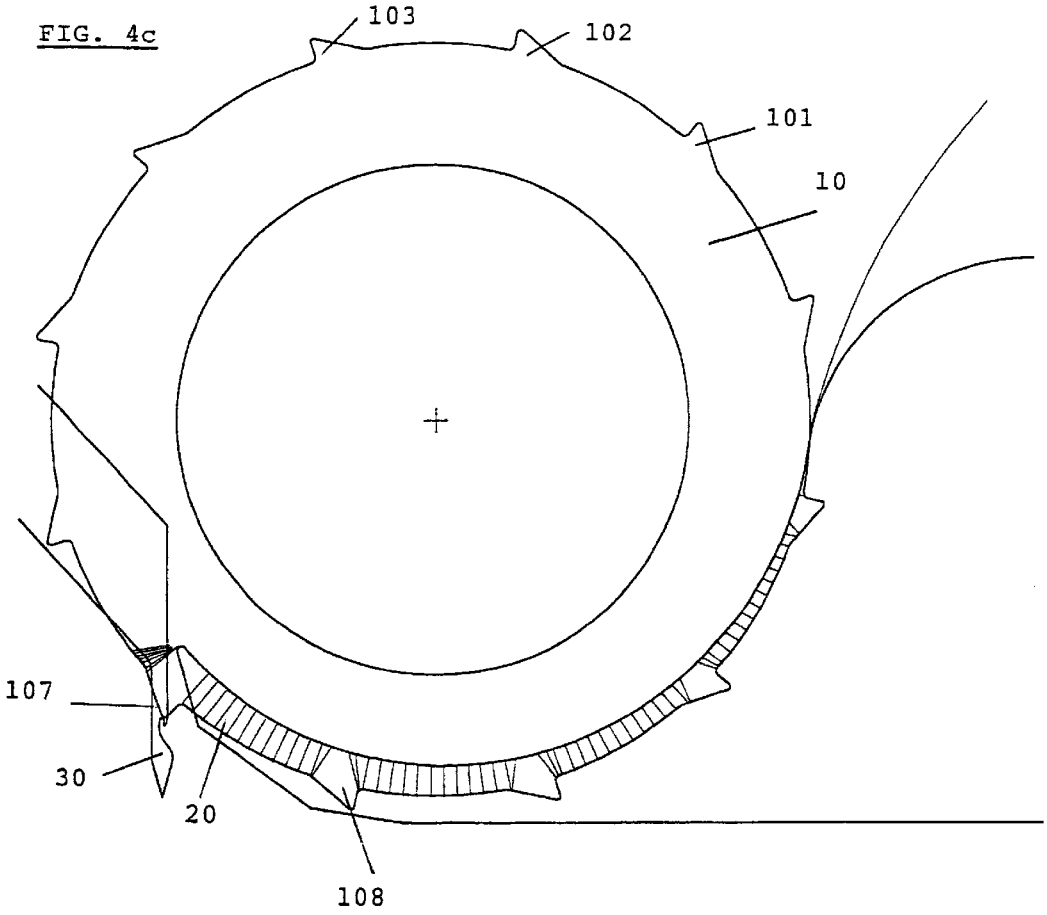

FIG. 4*c* (position at 300 degrees)

The following tooth "scrapes" the fibers accumulated against the needle, exerting a pressure which allows the fibers to be gathered in the form of a tight "strand" which constitutes the pseudo-yarn (analogous, except for the twist, to a yarn) and then to pass this pseudo-yarn through the needle. Specifically, the fibers forming a pseudo-yarn no longer have the ability to loop on the tooth.

Figure 4D:
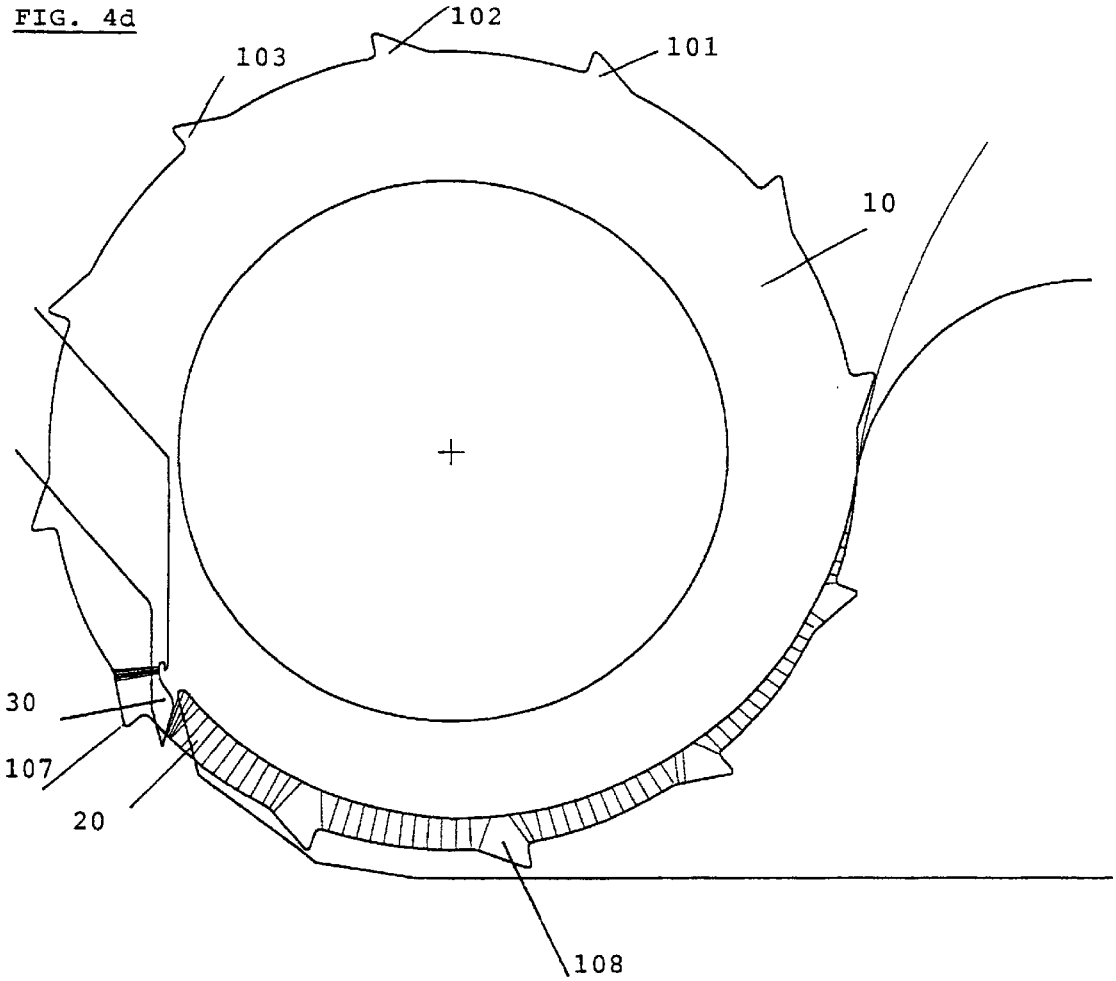

FIG. 4*d* (position at 0 degrees)

The yarn has advanced slightly while the needle has reached its top dead point. The distance between the base of the tooth where the fibers are accumulated and the bottom of the needle eye corresponds exactly to the looping value (distance between the end of the finger and the smooth part of the discs) which determines the height of the loop. The yarn is thus tensioned in the bottom of the needle eye, which will ensure its gripping by the needle. It should be noted that this gripping is entirely "positive" here and does not in any way depend on the nature of the fiber or its resilience.

Figure 4E:
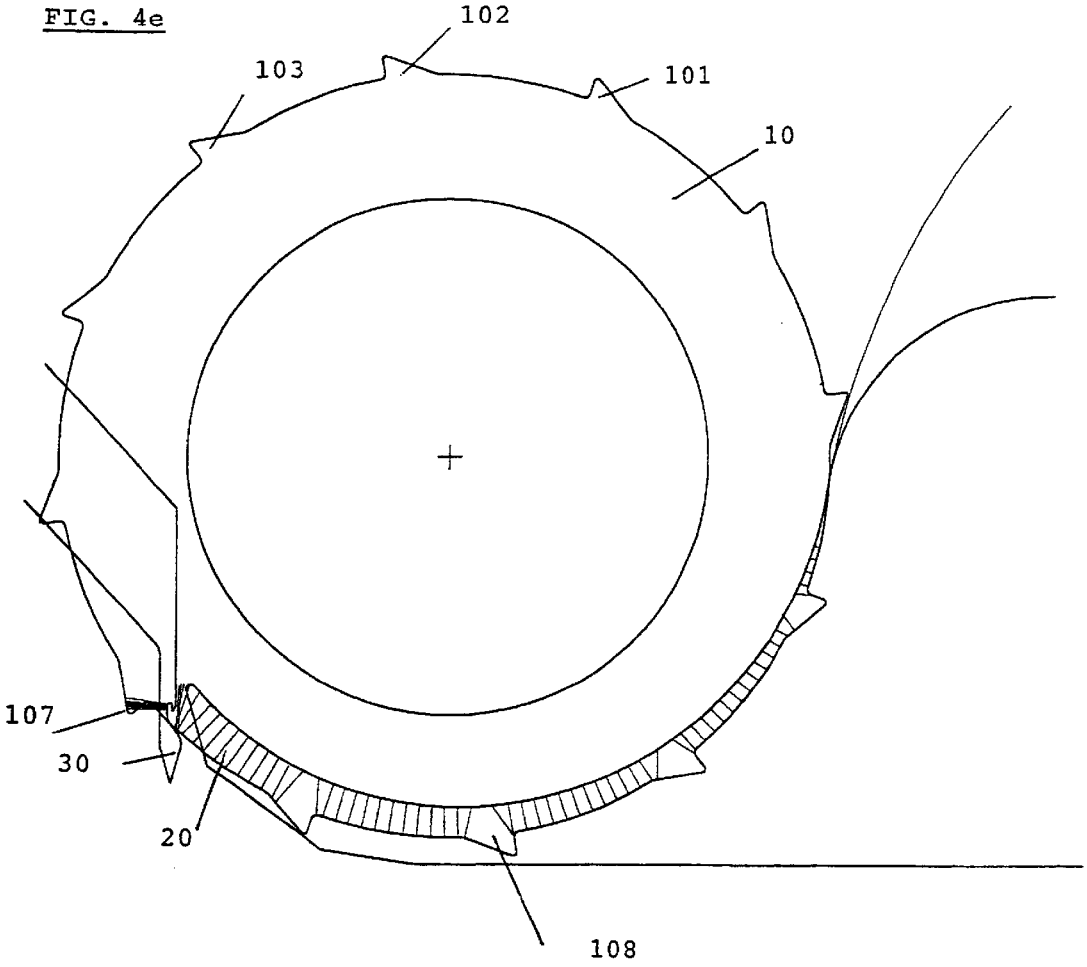

FIG. 4*e* (position at 30 degrees)

The needle has begun to descend. The profile of the tooth is designed such that the yarn is not retained, which is achieved if the horizontal distance between the bottom of the needle eye and the tooth, taking into account the needle/disc relative movements, is constant. The fibers which were located behind the tooth have begun to accumulate against the needle to constitute the yarn which will be taken up during the following cycle.

EXAMPLE 1

Line for a 2-Meter Product

This example describes a line for a two-meter product intended for motor vehicles, for example.

The aim is to produce a product of 400 g/m2 in 1/10 inch (2,54 mm) gauge with a feed per stroke of 2 mm using a fiber of 6.7 dtex 60 mm stroke.

A "short-fiber" carding machine generates a 40 g/m2 web with a useful width of 1 m.

This web is collected by the expander which expands it to 2 m while at the same time orienting the fibers around the average value of 20° (relative to the machine direction). The weight of the web has fallen to 20 g/m2.

The device according to the present invention is fitted with a set of identical discs 150 mm in diameter with 12 teeth (i.e. about 40 mm between the teeth). In this case, 40 mm of web in the machine direction will be condensed to form a yarn, which will be tufted every 2 mm. The weight of the product made is correctly 400=40×20/2.

If it is desired to vary the weight of the product, the only possibility is to vary the weight of the web. Since a carding-machine web cannot increase in weight indefinitely, it may be judicious to append to the carding machine a rotary condensing device, which is standard equipment in the field of nonwovens and will make it possible to increase the weight of the web directly on leaving the carding machine. The maximum productivity of this type of carding machine is of the order of 120 kg/h, which corresponds exactly to the output of a device according to the present invention (verticalization device) working at 1000 strokes/min. The productivities between upstream machines and downstream machines is of the order of 1. The line reaches here the maximum possible profitability.

EXAMPLE 2

Line for a 4-Meter Product

The line operates in a manner identical to that of Example 1. Two 1-meter carding machines will be used, the webs of which will be superposed to obtain, after 4-meter transverse drawing, a web of 20 g/m2 entering the device according to the present invention.

What is claimed is:

1. A device for manufacturing textile products from fibers and/or filaments travelling in the form of a web, comprising:

a set of identical looping discs wherein each member of said set is separated from its neighboring members by a space, said set of discs interpenetrating with a set of looping fingers, said discs comprising:

a common transverse shaft having a set of identical looping fingers; and a plurality of teeth on the perimeter of said discs and which are located on said common transverse shaft, wherein the distance between two successive teeth on the perimeter of the looping disc is at least three times the width of an individual tooth.

2. The device of claim 1, wherein the number of teeth on the perimeter of said looping discs is between about 8 and 16.

3. The device of claim 1, wherein the distance between two successive teeth on the perimeter of a looping disc is between about 20 and 60 mm.

4. The device of claim 1, wherein the height of the teeth is between about 1 and 5 mm.

5. The device of claim 1, wherein the slope of the teeth facing the arrival of the web is between about 20 and 40 degrees.

6. The device of claim 1, wherein the distance between two successive teeth on the perimeter of a looping disc does not exceed about 1.5 times the average length of the fibers and/or filaments of the web.

7. The device of claim 1, further comprising a transfer member, arranged in the extension of each looping finger.

8. The device of claim 7, wherein the transfer member carries out a sinusoidal rectilinear movement using a rod/cam system.

9. The device of claim 1, wherein the rotational movement of the looping discs located on the common transverse shaft is uniform.

10. The device of 1, further comprising a single main control shaft supporting cams and having a gear reduction which is defined by the number of teeth.

11. A process for manufacturing textile products from fibers and/or filaments travelling in the form of a web, wherein:

subjecting fibers and/or filaments to a transverse looping accompanied by a drawing using an assembly comprising a set of identical looping discs wherein each member of said set is separated from its neighboring members by a space, said set of discs interpenetrating with a set of looping fingers, said discs comprising a common transverse shaft having a set of identical looping fingers; and a plurality of teeth on the perimeter of said discs and which are located on said common transverse shaft, wherein the distance between two successive teeth on the perimeter of the looping disc is at least three times the width of an individual tooth;

accumulating the fibers and/or filaments in the form of at least one crimped pseudo-yarn of a certain length in which the fibers and/or filaments are parallelized, this accumulation of said fibers and/or filaments being carried out against the slope of a tooth facing the arrival of the web; and transferring the crimped pseudo-yarn to knitting elements or a set of needles simultaneously over the entire length of the pseudo-yarn.

12. The process of claim 11, wherein the web of fibers and/or filaments has on entry a weight of between 10 and 30 $g/m^2$.

13. The process of claim 11, wherein the average orientation of the fibers and/or filaments in the web on entering the device is between 10 and 25 degrees relative to the feed direction of the web.

14. The process of claim 11, wherein the entry web consists of fibers and/or filaments between 20 and 70 mm in length.

15. The process of claim 11, wherein a transverse drawing is carried out on the web prior to subjecting said fibers and/or filaments to said transverse looping accompanied by a drawing.

16. The device of claim 7, wherein said transfer member is selected from the group Consisting of a knitting element and a needle.

17. The device of claim 8, wherein the needles carry out a sinusoidal rectilinear movement using a rod/cam system.

* * * * *